US005162135A

United States Patent [19]

Gregory et al.

[11] Patent Number: 5,162,135

[45] Date of Patent: Nov. 10, 1992

[54] ELECTRICALLY CONDUCTIVE POLYMER MATERIAL HAVING CONDUCTIVITY GRADIENT

[75] Inventors: Richard V. Gregory, Anderson; William C. Kimbrell, Jr., Spartanburg; Mark E. Cuddihee, Greenville, all of S.C.

[73] Assignee: Milliken Research Corporation, Spartanburg, S.C.

[21] Appl. No.: 589,125

[22] Filed: Sep. 27, 1990

Related U.S. Application Data

[63] Continuation-in-part of Ser. No. 448,035, Dec. 8, 1989.

[51] Int. Cl.[5] ..... B05D 5/12

[52] U.S. Cl. ..... 427/121; 252/500; 252/512; 252/518; 427/342; 428/195; 428/196; 428/257

[58] Field of Search ..... 252/500, 512, 518; 427/121, 58, 389.9, 342; 428/195, 196

[56] References Cited

U.S. PATENT DOCUMENTS

| | | | |
|---|---|---|---|
| 4,877,646 | 10/1989 | Kuhn et al. | 427/121 |
| 4,975,317 | 12/1990 | Kuhn et al. | 427/58 X |
| 4,981,718 | 1/1991 | Kuhn et al. | 427/121 |
| 5,006,278 | 4/1991 | Eisenbaumer | 252/500 X |

*Primary Examiner*—Michael Lusignan

*Attorney, Agent, or Firm*—Timothy J. Monahan; H. William Petry

[57] ABSTRACT

A conductive polymeric material such as a textile fabric having a conductive polymer film may be treated with a solution containing a chemical reducing agent to reduce its conductivity. By selectively reducing portions of the conductive polymer in varying degrees, a gradient of conductivity may be produced in the material. After the conductive polymer has been reduced to a target level, the reducing solution may be removed with a hot water rinse.

58 Claims, 3 Drawing Sheets

*FIG. —1—*

ELECTRICALLY CONDUCTIVE POLYMER MATERIAL HAVING CONDUCTIVITY GRADIENT

RELATED APPLICATIONS

This application is a continuation-in-part of U.S. patent application Ser. No. 07/448,035, titled "FABRIC HAVING NON-UNIFORM ELECTRICAL CONDUCTIVITY", filed Dec. 8, 1989, specific reference being made herein to obtain the benefit of its earlier filing date.

BACKGROUND OF THE INVENTION

1. Field of the Invention

This invention relates generally to conductive polymers and conductive polymer films on textile materials and particularly to a method of selectively chemically reducing a portion of the conductive polymer to create a gradient.

2. Prior Art

The existence of organic polymers which are electrically conductive is well known. For example, polyacetylene, polypyrrole, polyaniline and polythiophthene have been the subject of scientific inquiry over the last several years. One of the limitations on the application of conductive polymers has been their lack of stability to environmental conditions resulting in a decline in conductivity with age. The influence of temperature, humidity and oxidation level on the stability of conducting polymers was discussed in Munstedt, H., "Aging of Electrically Conducting Organic Materials", *Polymer*, Volume 29, Pages 296–302 (February, 1988).

Conductive polymers may be produced in a wide variety of forms. The polymers may be cast as films, deposited on the surface of fibers or precipitated from solution. Although relatively difficult to process, some conductive polymers may be shaped by molding or extrusion.

Materials incorporating conductive polymers are useful in controlling static electricity, shielding from electromagnetic energy and generation of local heat by resistance heating. In some applications, it is desirable that a material incorporating a conductive polymer exhibit non-uniform conductivity, such as a gradient of decreasing conductivity in a particular direction. Other applications involving the distribution or disperse of electromagnetic energy by anisotropic electrically conductive article will become apparent to those skilled in the art.

SUMMARY OF THE INVENTION

Therefore, one of the objects of this invention is to provide a conductive polymeric material having non-uniform conductivity in a particular direction. Another object of the invention is to provide a conductive polymeric material with a conductivity gradient.

Accordingly, a process for selectively lowering the electrical conductivity of a conductive polymeric material is provided comprising contacting a portion of the polymeric material with a solution containing a reducing agent capable of chemically reducing the polymeric material. The selected portion of polymeric material and the solution containing the reducing agent are maintained in contact for a sufficient time to lower the conductivity of that portion.

The degree to which conductivity is lowered in the selected portion is dependent upon the strength of the reducing agent, contact time and temperature. The process features the ability to reduce different portions of the polymeric material by different degrees. A rinse may be employed to remove, dilute, degrade or otherwise neutralize the reducing agent and halt further reduction of the polymer. An additional feature of the invention is production of a conductivity gradient in a textile material coated with a conductive polymer.

Advantages of the invention include the ability to produce gradients with analog or digital characteristics, lower the conductivity of conductive polymers without destroying the polymer backbone, produce relatively stable gradients in conductive polymers and accurately control reduction of polymer conductivity.

DESCRIPTION OF THE PREFERRED EMBODIMENT

Figure 1:
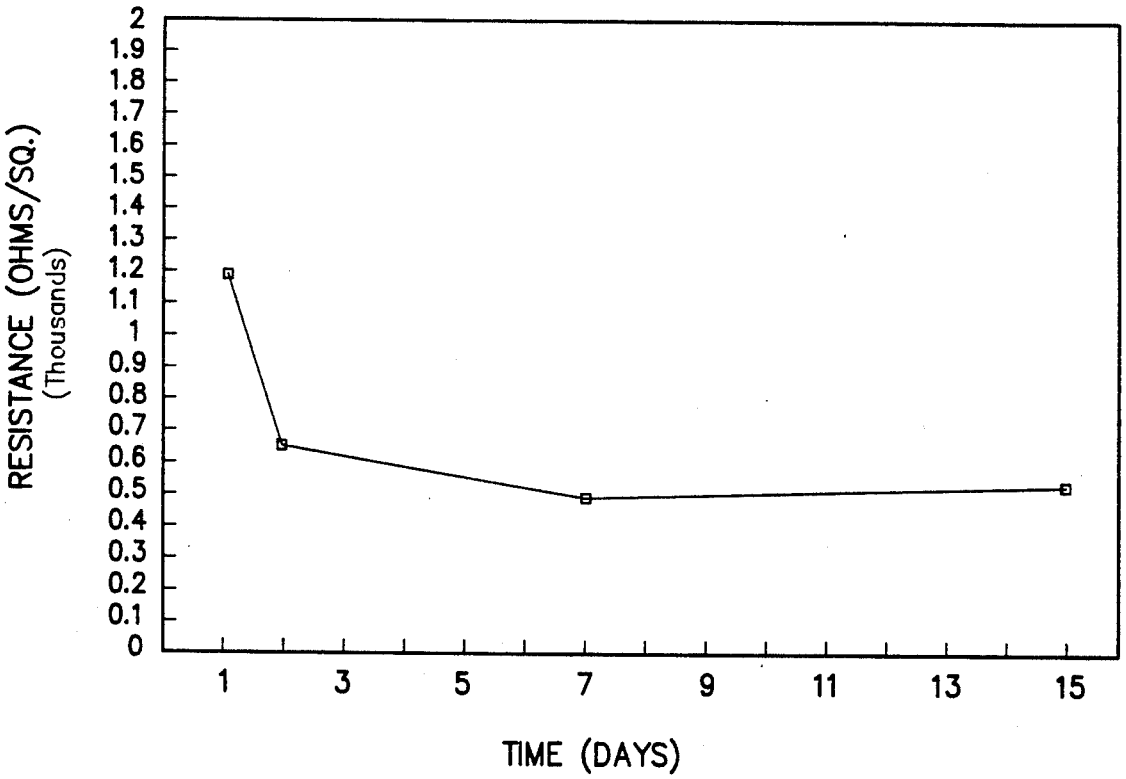
FIG. 1 is a graph of resistance versus time for a conductive polymeric material which has been reduced and then rinsed with cold water.

Without limiting the scope of the invention, the preferred features of the invention are hereinafter set forth.

The conductive polymers useful herein are organic polymers which are intrinsically conductive or can be made conductive by treatment with a suitable dopant. Examples of conductive organic polymers are polyacetylene, polypyrrole, polyaniline, polythiophthene, poly-p-phenylene, poly(phenylene sulfide), poly(1,6-heptadiyne), polyazulene, poly(phenylene vinylene), and polyphthalocyanines. In some instances, polymers which are not intrinsically conductive may be either oxidized or reduced electrochemically to give conductivity. Polymers which have been oxidized to achieve conductivity are useful herein.

Of the foregoing conductive polymers, polypyrrole compounds and polyaniline compounds are preferred. The terms "polypyrrole compounds" and "polyaniline compounds" are intended to include substituted polymers of polypyrrole and polyaniline which can be made conductive. By way of example and not limitation, the following monomers are suitable for polypyrrole compounds: pyrrole, 3- and 3,4- alkyl or aryl-substituted pyrrole, N-alkylpyrrole, and N-arylpyrrole. Similarly, the following monomers are suitable for polyaniline compounds: aniline, 3- and 3,4-chloro, bromo, alkyl or aryl-substituted aniline. More preferably, the conductive polymers useful herein are polypyrrole and polyaniline.

Some conductive polymers may be cast as films, extruded, coextruded with thermoplastic resins, molded, spun or deposited on a substrate. These and other forms of which conductive polymers which may be produced by those skilled in the art are referred to herein as conductive polymeric materials. The following references, hereby incorporated by reference, contain examples of conductive polymer synthesis and applications: "Conducting Polymers, Special Applications", Alacer, Luis editor, D. Reidel Publishing Co., Dordrecht, Holland (1987); Aldissi, M., "Inherently Conducting Polymers, Processing, Fabrication, Applications, Limitations", NOyes Data Corp., New Jersey (1989).

In a preferred embodiment, a textile material is coated with a uniform film of conductive polymer. Techniques for producing electrically conductive textile materials are disclosed in the following U. S. patents and patent applications which are incorporated by reference herein:

| U.S. Pat. No. or Ser. No. | Inventor | Title |
|---|---|---|
| 4,803,096 | Kuhn et al. | Electrically Conductive Textile Material and Method for Making Same |
| 4,877,646 | Kuhn et al. | Method for Making Electrically Conductive Textile Materials |
| 07/211,628 Filed 06/27/88 | Kuhn et al. | Method for Making Electrically Conductive Textile Materials |

The conductive polymer is formed on the textile material in amounts corresponding to about 0.5 percent to about 4 percent, preferably amount 1.0 percent to about 3.0 percent, especially preferred about 1.5 percent to about 2.5 percent, by weight based on the weight of the fabric. Thus, for example, for a fabric weighing 100 grams, a polymer film of about 2 grams may typically be formed on the fabric.

A wide variety of textile materials may be employed in the present invention such as fibers, filaments, yarns and fabrics made therefrom. The fabric may be woven, nonwoven or knitted. Continuous filament yarns are preferred.

A wide variety of natural and synthetic fibers may be used. Thus, for instance, cotton, wool and other natural fibers may be employed. Synthetic yarns such as polyester, nylon and acrylic yarns may be conveniently employed. More preferably, fibers of polyethylene terephthalate, nylon 6, nylon 6,6, high modulus fibers such as aromatic polyester, aromatic polyamide, and polybenzimidazole. Blends of synthetic and natural fibers may also be used. Still another category of fibers that may be advantageously employed include high modulus inorganic fibers such as glass, quartz and ceramic fibers. Still further, fibers made of KEVLAR ®, NOMEX ®, and silicone carbide may be used.

Conductivity measurements have been made on the fabrics which have been prepared according to the aforementioned methods. Standard test methods are available in the textile industry and, in particular, AATCC test method 76-1982 is available and has been used for the purpose of measuring the resistivity of textile fabrics. According to this method, two parallel electrodes, two inches long, are contacted with the fabric and placed one inch apart. Resistivity may then be measured with a standard ohm meter capable of measuring values of between one and twenty million ohms. Measurements must then be multiplied by two in order to obtain resistivity in ohms on a per square basis. While conditioning of the samples may ordinarly be required to specific relative humidity levels, it has been found that conditioning of the samples made according to the present invention is not necessary since conductivity measurements do not vary significantly at different humidity levels. The measurements reported in the following examples are however, conducted in a room which is set to a temperature of 70° F. and 50 percent relative humidity. Resistivity measurements are reported herein and in the examples in ohms per square (Ω/sq.) and under these conditions the corresponding conductivity is one divided by resistivity.

Conductive polymeric material may be treated with a solution containing a reducing agent to lower its conductivity. The solution containing the reducing agent is contacted with the polymeric material under conditions of concentration, time and temperature sufficient to reduce the conductive polymer by a desired amount. The entire polymeric material need not be treated uniformly. In a preferred embodiment, portions of the polymeric material are reduced in varying degrees to produce anisotropic material or a gradient.

Electrically conductive textile materials prepared according to the above referenced patents are coated with a substantially uniform thickness of polymer. The textile material may, in the case of woven textiles, show slightly different conductivity in the warp and weft direction. However, the conductivity of the textile material remains substantially uniform as one travels in any given direction.

The area of a textile material or other conductive polymeric material may be considered to comprise a plurality of individual sections or portions, such as horizontal strips. If the conductive textile material is to be treated with a solution, it can be seen that a portion of the material may be treated while the remaining portions can be left untreated. Alternatively, portions of the conductive textile material may be treated, and thus reduced, in varying degrees to produce an anisotropic electrically conductive article. For example, an electrically conductive textile material may be gradually lowered into a heated solution containing a reducing agent. The material that is in the solution the longest will be reduced the most. The material may be continuously lowered to produce an analog gradient or lowered in steps to produce a digital gradient. After the conductive textile material is removed from the solution the material may be rinsed to halt further reduction after the conductivity of the material has been sufficiently lowered.

The solution applied to the conductive polymeric material contains a reducing agent capable of chemically reducing the polymeric material. In other words, the reducing agent is able to decrease the oxidation level of the polymer, thereby lowering its conductivity. Examples of suitable reducing agents are zinc formaldehyde sulfoxylate, sodium formaldehyde sulfoxylate, thiourea dioxide, sodium hydrosulfite, sodium borohydride, zinc, hydrazine, and stannous chloride. Preferably, the reducing agent contains a zinc ion. More preferably, the reducing agent is zinc formaldehyde sulfoxylate. Aqueous solutions of the reducing agent are also preferred.

The concentration of reducing agent in solution will vary depending upon the time of contact with the conductive polymer, temperature and degree of reduction desired. Preferably, a molar excess of reducing agent is provided relative to the theoretical requirement to reduce the oxidation level of the polymer to a target level. Levels of reducing agent in the solution from 0.1 grams per liter to 100 grams per liter may be employed.

The reducing solution is preferably contacted with the polymeric material at a temperature above 25° C. At temperatures below 25° C., the reaction proceeds very slowly. More preferably, the solution is heated above 50° C. The upper limit for heating the solution containing the reducing agent is dictated by its boiling point (approximately 100° C.) or considerations of degradation of the reducing agent, conductive polymer, or substrate.

In one embodiment, the reducing solution is contacted with the conductive polymeric material followed by application of steam. Further, the steam may be selectively applied over an area of the material to vary the reaction rate and thus, the conductivity of the treated material. Although temperatures higher than 100° C. may be realized with steam application, the accelerated reaction rate, and thus shorter reaction time, may overcome the aforementioned problems associated with degradation.

In addition to dipping a conductive textile material in a bath containing a reducing solution, a variety of other methods may be employed to contact the solution and material. For example, a solution containing a reducing agent may be sprayed on the material in a desired pattern. A machine for spraying dye on textile products which may be adapted for use herein is described in Pascoe, Sr. et al., "Apparatus For The Application Of Liquids To Moving Materials, U.S. Pat No. 4,095,444. The reducing solution may be preheated, or heated while in contact with the conductive textile material by a variety of methods known to those skilled in the art including steaming. Additionally, solutions containing reducing agents of varying reactivity could be applied to different portions of the material.

The reducing solution and conductive polymeric material remain in contact for a sufficient time to lower the conductivity of the material. The reducing solution may be rinsed from the material to halt reduction when a target level has been reached. Otherwise, when the solution is left on the material, one may expect further reduction of the polymeric material, even after the material has cooled and dried.

The rinse is preferably a solvent in which the reducing solution is soluble. It has been found that the rinse works better if performed at a relatively hot temperature, for example, above 50° C. When the reducing solution is aqueous, a hot water rinse may be used.

Figure 2:
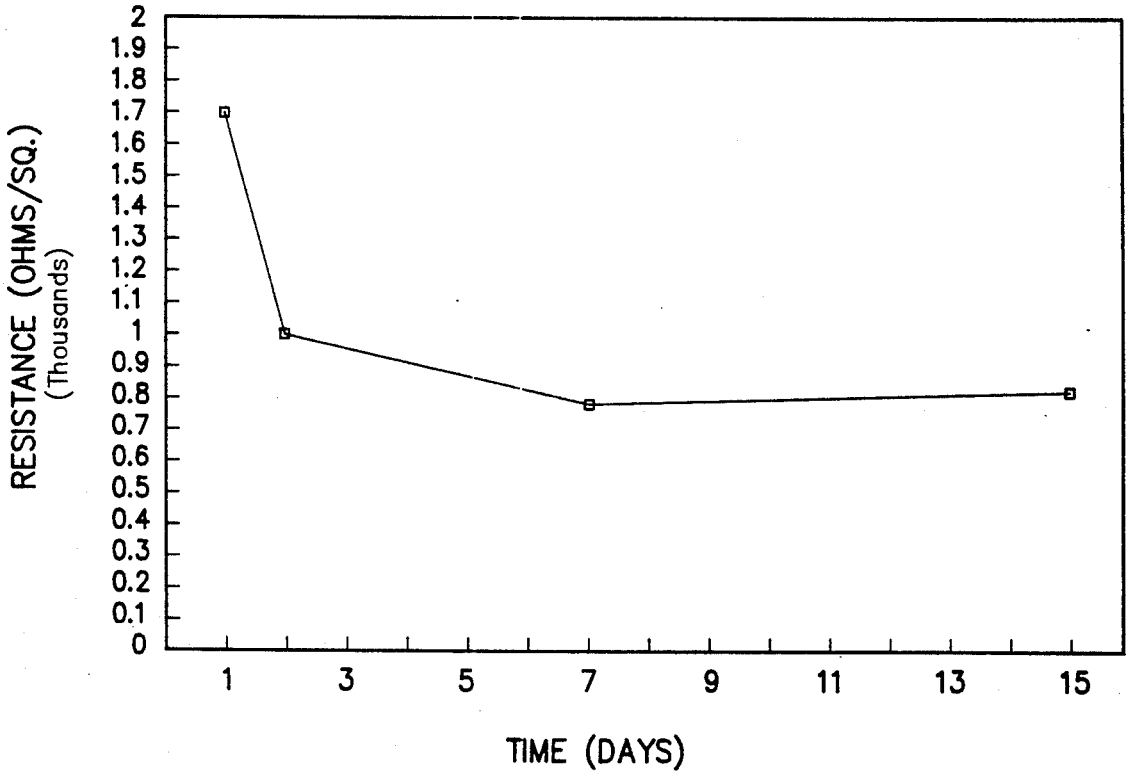
FIG. 2 is a graph of resistance versus time for a conductive polymeric material which has been reduced and then rinsed with hot water.

A comparison of a cold water rinse and a hot water rinse is shown in FIGS. 1 and 2. Identical samples of a polypyrrole coated, glass fiber textile material were submerged in a heated solution of zinc formaldehyde sulfoxylate and either rinsed in cold or hot water. As can be seen in FIGS. 1 and 2, the sample rinsed in hot water had a higher resistance and maintained a higher resistance than the cold water rinsed sample. Further details of the experiment are set forth in Example 13.

Figure 3:
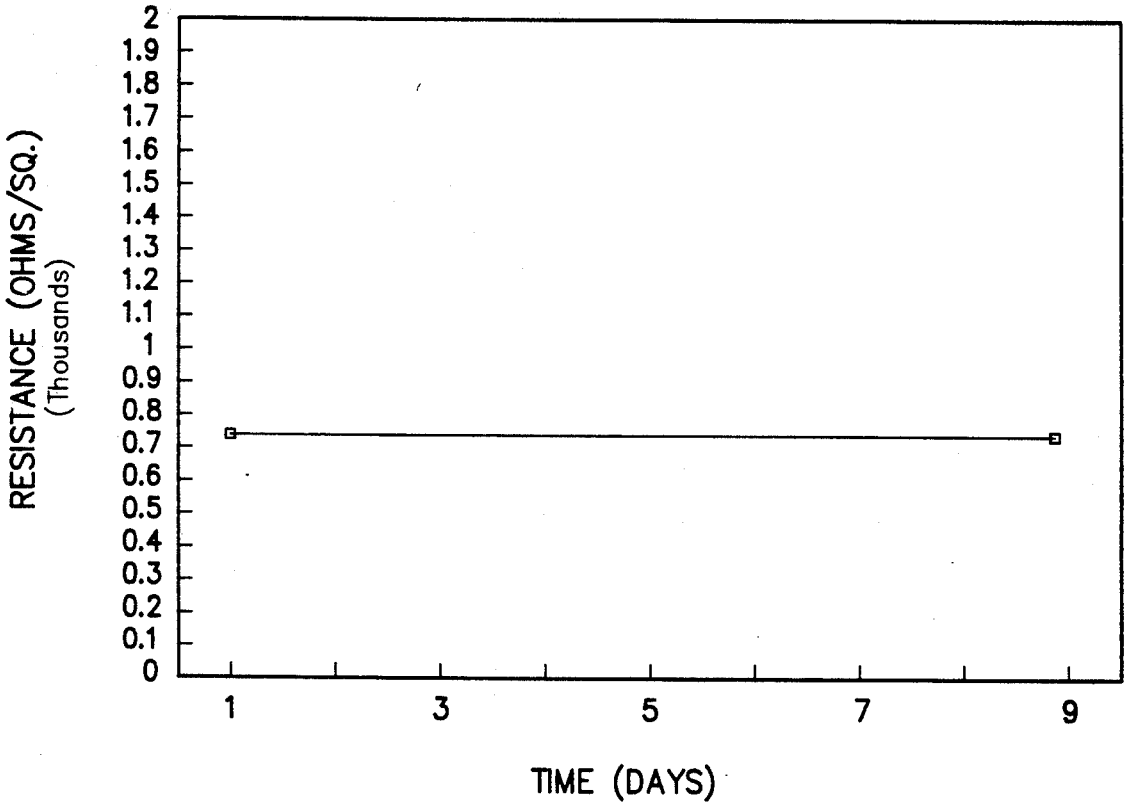
FIG. 3 is a graph of resistance versus time for a conductive polymeric material which has been reduced in the presence of urea and then rinsed with hot water.

In another embodiment of the invention, urea is present in the reducing solution and the reducing agent employed is zinc formaldehyde sulfoxylate or other reducing agent containing formaldehyde. After the aqueous reducing solution containing urea is contacted with a conductive polymeric material for a desired length of time, the material is rinsed in hot water. The presence of urea adds stability to the resulting reduced polymeric material. It is believed that urea in concentrations in the reducing solution from 0.05 grams per liter to 100 grams per liter acts as a complexing agent for formaldehyde. A plot of resistance versus time for a conductive polymer reduced in the presence of urea is shown in FIG. 3 and further described in Example 14.

The invention may be further understood by reference to the following examples, but the invention is not to be construed as being unduly limited thereby. Unless otherwise indicated, all parts and percentages are by weight.

EXAMPLE 1

A woven glass fabric (JPS S/26781) was treated according to the method described in U.S. Pat. No. 4,803,096 to obtain a uniformly polypyrrole treated fabric With a surface resistance of approximately 10 ohms per square.

Ten grams of zinc formaldehyde sulfoxylate (Parolite from Royce Chemical) was dissolved in 500 ml of water and heated to 55° C.

Two-inch by two-inch squares of the above-described fabric were placed in the above solution. Samples of the fabric were removed at various times, rinsed well with cold water and air dried. Results are described in Table 1.

TABLE 1

| Treatment Time | Surface Resistance (ohms per square) |
|---|---|
| 0 minutes | 10.3 |
| 5 minutes | 16.6 |
| 10 minutes | 51.6 |
| 15 minutes | 138.8 |
| 30 minutes | 543.9 |
| 45 minutes | 704 |
| 60 minutes | 1321 |

EXAMPLE 2

Example 1 was repeated, except that the Parolite solution temperature was increased to 75° C. Results are summarized in Table 2.

TABLE 2

| Treatment Time | Surface Resistance (ohms per square) |
|---|---|
| 0 minutes | 12.0 |
| 15 minutes | 239 |
| 25 minutes | 540 |
| 35 minutes | 755 |
| 45 minutes | 1221 |
| 55 minutes | 1399 |

EXAMPLE 3

Example 1 was repeated, except that the Parolite solution was maintained at room temperature (25° C.). Results are summarized in Table 3.

TABLE 3

| Treatment Time | Surface Resistance (ohms per square) |
|---|---|
| 0 minutes | 11.1 |
| 15 minutes | 11.3 |
| 25 minutes | 11.7 |
| 35 minutes | 12.2 |
| 45 minutes | 12.3 |
| 55 minutes | 13.1 |

EXAMPLE 4

Example 2 was repeated, except that no Parolite was dissolved in the water. Results are summarized in Table 4.

TABLE 4

| Treatment Time | Surface Resistance (ohms per square) |
|---|---|
| 0 minutes | 13.0 |

TABLE 4-continued

| Treatment Time | Surface Resistance (ohms per square) |
|---|---|
| 15 minutes | 15 |
| 25 minutes | 16 |
| 35 minutes | 17.4 |
| 45 minutes | 17.8 |
| 55 minutes | 18.3 |

EXAMPLE 5

Example 2 was repeated, except that instead of Parolite, 10 grams of thiourea dioxide (Glo-lite T.D. from Gl-Tex Chemical) was used. Results are summarized in Table 5.

TABLE 5

| Treatment Time | Surface Resistance (ohms per square) |
|---|---|
| 0 minutes | 12.0 |
| 15 minutes | 28.1 |
| 25 minutes | 41.1 |
| 35 minutes | 48.9 |
| 45 minutes | 118.3 |
| 55 minutes | 254.0 |

EXAMPLE 6

Example 2 was repeated, except that 6.81 grams of sodium bithionite was used instead of Parolite. Results are summarized in Table 6.

TABLE 6

| Treatment Time | Surface Resistance (ohms per square) |
|---|---|
| 0 minutes | 12.0 |
| 15 minutes | 40 |
| 25 minutes | 61 |
| 35 minutes | 97 |
| 45 minutes | 84 |
| 55 minutes | 97 |

EXAMPLE 7

Example 2 was repeated, except that only 5 grams Parolite was used. Results are summarized in Table 7.

TABLE 7

| Treatment Time | Surface Resistance (ohms per square) |
|---|---|
| 0 minutes | 13.0 |
| 15 minutes | 275 |
| 25 minutes | 437 |
| 35 minutes | 514 |
| 45 minutes | 629 |
| 55 minutes | 675 |

EXAMPLE 8

A piece of textured woven polyester fabric (Milliken S/205) was treated according to the method described in U.S. Pat. No. 4,803,096 to obtain a uniformly polypyrrole treated fabric with a surface resistance of approximately 200 ohms per square.

Two-inch by two-inch squares of the above fabric were soaked in various concentrations of Parolite for 8 minutes then steamed for 12 minutes and air dried. Results are summarized in Table 8.

TABLE 8

| Parolite Concentration | Surface Resistance (ohms per square) |
|---|---|
| 0 grams per liter | 212 |
| 5 grams per liter | 220 |
| 10 grams per liter | 138 |
| 15 grams per liter | 512 |
| 20 grams per liter | 863 |

This Example demonstrates that by controlling the amount of reductant applied to the fabric, such as by the process described in U.S. Pat. No. 4,095,444 one can alter the surface resistance of a fabric treated uniformly with polypyrrole.

EXAMPLE 9

This Example demonstrates how to alter the surface resistance of a fabric which is previously uniformly treated with polypyrrole to obtain discrete increments of differing resistances.

A 3.5 liter solution containing 20 grams per liter of zinc formaldehyde sulfoxylate was prepared. This solution was placed in a 4 liter beaker and heated to 75° C.

A twelve-inch by twelve-inch square of conductive quartz fabric, prepared as in Example 1 and having a surface resistance of approximately 30 ohms per square, was used. The fabric was formed into a cylinder by overlapping and stapling the sides.

The beaker containing the reducing solution and a heater were placed on a jack lift. The quartz fabric cylinder was suspended over the reducing solution and clamped into place with a clothespin. The jack was adjusted so that one inch of the quartz cylinder became immersed in the solution.

The jack was raised one inch every ten minutes thereby submersing another inch of the quartz fabric cylinder. The experiment was continued until the cylinder contacted the bottom of the beaker.

Next the quartz cylinder was removed from the solution, rinsed and dried.

Using an analog multi-meter across the one-inch bands along the length of the cylinder, the resistance was found to vary from 30 to 5,000 ohms per square.

EXAMPLE 10

Example 2 is repeated, except that the fabric used is of the type described in EXAMPLE 8, however the initial surface resistance was approximately 77 ohms per square. Results are summarized in Table 10.

TABLE 10

GRADIENT ON POLYPYRROLE TREATED POLYESTER (ZFS SOLUTION AT 75° C. WITH HOT WATER RINSE)

| Time (Minutes) | Resistivity (Ohms per square) |
|---|---|
| 0 | 77 |
| 15 | 6370 |
| 25 | 8860 |
| 35 | 11610 |
| 45 | 12150 |
| 55 | 15230 |
| 65 | 17590 |

EXAMPLE 11

Example 2 is repeated except that the fabric is a textured nylon (Test Fabrics S/314) with an initial surface resistance of 340 ohms per square. Results are summarized in Table 11.

TABLE 11

| GRADIENT ON POLYPYRROLE TREATED NYLON | |
|---|---|
| Time (Minutes) | Resistivity (Ohms per square) |
| 0 | ~340 |
| 15 | 108,000 |
| 25 | 80,000 |
| 35 | 186,000 |
| 45 | 124,000 |
| 55 | 176,000 |
| 65 | 330,000 |

EXAMPLE 12

Example 2 is repeated, except that the fabric used is described in Example 8 and was treated with polyaniline instead of polypyrrole. The initial surface resistance was 1900 ohms per square. Results are summarized in Table 12.

TABLE 12

| GRADIENT ON POLYANILINE TREATED POLYESTER | |
|---|---|
| Time (Minutes) | Resistivity (Ohms per square) |
| 0 | ~1900 |
| 16 | 2177 |
| 30 | 2064 |
| 45 | 2893 |
| 60 | 3742 |

EXAMPLE 13

Two-inch by two-inch squares of glass fabric as disclosed in Example 1 were placed into a 10 gram per liter solution of zinc formaldehyde sulfoxylate at 75° C. for 45 minutes. The samples were subsequently removed from this solution and rinsed as follows:

a) five minutes overflow cold tap water (≈27° C.)

b) five minutes overflow hot tap water (≈80° C.)

The resistance of these samples were measured after air drying and remeasured after several days. Results are plotted in FIGS. 1 and 2.

EXAMPLE 14

Examples 13 was repeated, except that five grams of urea was added to the zinc formaldehyde sulfoxylate solution. Results are plotted in FIG. 3.

There are, of course, many obvious alternate embodiments and modifications of the invention which are intended to be included within the scope of the following claims.

What we claim is:

1. A process for lowering the conductivity of a conductive polymeric material selected from a polypyrrole compound and a polyaniline compound, comprising the steps of contacting a portion of said polymeric material with a solution containing a reducing agent capable of chemically reducing said polymeric material and maintaining contact between said solution and said portion of said polymeric material for a sufficient time to lower the conductivity of said portion.

2. A process according to claim 1, further comprising rinsing said portion of said polymeric material with a second solution to substantially terminate chemical reduction of said polymeric material by said reducing agent, wherein said first solution is soluble in said second solution.

3. A process according to claim 2, wherein said reducing agent is selected from zinc formaldehyde sulfoxylate;
sodium formaldehyde sulfoxylate;
thiourea dioxide;
sodium hydrosulfite;
sodium borohydride;
zinc;
hydrazine;
and stannous chloride.

4. A process according to claim 2, wherein said reducing agent comprises zinc formaldehyde sulfoxylate.

5. A process according to claim 2, wherein said reducing agent is selected from zinc formaldehyde sulfoxylate and sodium formaldehyde sulfoxylate and said solution comprises 0.1 gram/liter to 100 gram/liter of said reducing agent, said solution further comprising from 0.05 gram/liter to 100 gram/liter of urea.

6. A process according to claim 2, wherein said polymeric material is in the form of a coating on a textile material.

7. A process according to claim 6, wherein said textile material is a knitted, woven or non-woven fibrous textile fabric.

8. A process according to claim 2, wherein said polymeric material is a polypyrrole compound comprising monomers selected from pyrrole, 3- and 3,4- alkyl or aryl substituted pyrrole, Nalkyl pyrrole and N-aryl pyrrole.

9. A process according to claim 2, wherein said polymeric material is polypyrrole.

10. A process according to claim 2, wherein said polymeric material is a polyaniline compound comprising monomers selected from aniline and 3- and 3,4-chloro, bromo, alkyl or aryl substituted aniline.

11. A process according to claim 2, wherein said polymeric material is polyaniline.

12. A process according to claim 1, wherein said solution is an aqueous solution and is heated to a temperature of at least 25° C.

13. A process according to claim 12 wherein sadd solution is heated to a temperature of at least 50° C.

14. A process according to claim 2, wherein steam is applied to said polymeric material while it is in contact with said solution.

15. A process according to claim 13, wherein said reducing agent is present in said solution at a concentration of between 0.1 grams per liter and 100 grams per liter.

16. A process according to claim 2, wherein said second solution is aqueous and is applied at a temperature greater than 50° C.

17. A process for raising the resistivity of a conductive polymeric material selected from a polypyrrole compound and a polyaniline compound, comprising the steps of contacting a first portion of said polymeric material with a solution containing a reducing agent capable of chemically reducing said polymeric material, contacting a second portion of said polymeric material with said solution, maintaining contact between said solution and said first portion of said polymeric material until the resistivity of said first portion is raised to a level, $L_1$ ohms per square, and maintaining contact between said solution and said second portion of said polymeric material until the resistivity of said second portion is raised to a level, $L_1$ ohms per square, whereby L is greater than $L_2$.

18. A process according to claim 17, wherein said first portion of said polymeric material is maintained in contact with said solution for a greater period of time than said second portion is maintained in contact with said solution.

19. A process according to claim 17, wherein a greater volume of said solution is contacted per unit of area of said first portion than is contacted per unit of area of said second portion of said polymeric material.

20. A process according to claim 17, wherein a concentration of said reducing agent in said solution is greater in said solution contacted with said first portion than in said solution contacted with said second portion of said polymeric material.

21. A process according to claim 17, further comprising rinsing said portion of said polymeric material with a second solution to substantially terminate chemical reduction of said polymeric material by said reducing agent, wherein said first solution is soluble in said second solution.

22. A process according to claim 21, wherein said reducing agent is selected from zinc formaldehyde sulfoxylate;
sodium formaldehyde sulfoxylate;
thiourea dioxide;
sodium hydrosulfite;
sodium borohydride;
zinc;
hydrazine;
and stannous chloride.

23. A process according to claim 21, wherein said reducing agent comprises zinc formaldehyde sulfoxylate.

24. A process according to claim 21, wherein said polymeric material is in the form of a coating on textile material.

25. A process according to claim 21, wherein said polymeric material is polypyrrole.

26. A process according to claim 21, wherein said polymeric material is polyaniline.

27. A process according to claim 21, wherein said solution is an aqueous solution and is heated to a temperature of at least 50° C.

28. A process according to claim 21, wherein steam is applied to said polymeric material while it is in contact with said solution.

29. A process according to claim 28, wherein a greater amount of steam is applied to said first portion than said second portion of said polymeric material.

30. A process for raising the resistivity of a conductive polymeric material selected from a polypropylene compound and a polyaniline compound, comprising the steps of contacting a first portion of said polymeric material with a first solution containing a first reducing agent capable of chemically reducing said polymeric material, contact a second portion of said polymeric material with a second solution containing a second reducing agent capable of chemically reducing said polymeric material, maintaining contact between said first solution and said first portion of said polymeric material until the resistivity of said first portion is raised to a level, $L_1$ ohms per square, and maintaining contact between said second solution and said second portion of said polymeric material until the resistivity of said second portion is raised to a level, $L_2$ ohms per square, whereby $L_1$ is greater than $L_2$.

31. A process according to claim 30, further comprising rinsing said first and second portions of said polymeric material with a third solution to substantially terminate chemical reduction of said polymeric material by said first and second reducing agent, wherein said first and second solutions are soluble in said third solution.

32. A process according to claim 31, wherein said first and second reducing agents is selected from zinc formaldehyde sulfoxylate;
sodium formaldehyde sulfoxylate;
thiourea dioxide;
sodium hydrosulfite;
sodium borohydride;
zinc;
hydrazine;
and stannous chloride.

33. A process according to claim 32, wherein said polyminc material is in the form of a coating on a textile material.

34. A process according to claim 33, wherein said polymeric material is a polypyrrole compound comprising monomers selected from pyrrole, 3- and 3,4- alkyl or aryl substituted pyrrole, N-alkyl pyrrole and N-aryl pyrrole.

35. A process according to claim 34, wherein said first and second solutions are aqueous and are heated to a temperature of at least 50° C.

36. A process for introducing a resistivity gradient in a substrate coated with a polymeric material selected from a polypyrrole compound and a polyaniline compound, comprising the steps of contacting a first portion of said substrate with a solution containing a reducing agent capable of chemically reducing said polymeric material, said reducing agent selected from zinc formaldehyde sulfoxylate; sodium formaldehyde sulfoxylate; thiourea dioxide; sodium hydrosulfite; sodium borohydride; zinc; hydrazine; and stannous chloride, contacting a second portion of said substrate with said solution, maintaining contact between said solution and said first portion of said polymeric material at a temperature of between 25° C and 100° C. until the resistivity of said first portion is raised to a level, $L_1$ ohms per square, and maintaining contact between said solution and said second portion of said polymeric material at a temperature of between 25° C. and 100° C. until the resistivity of said second portion is raised to a level $L_2$ ohms per square, whereby $L_1$ is greater than $L_2$.

37. A process according to claim 36, wherein said substrate is a knitted, woven or non-woven fibrous textile fabric.

38. A process according to claim 37, wherein said reducing agent is selected from zinc formaldehyde sulfoxylate and sodium formaldehyde sulfoxylate, said solution containing 0.1 gram/liter to 100 gram/liter of said reducing agent, said solution further comprising from 0.05 gram/liter to 100 gram/liter of urea.

39. A process according to claim 37, wherein said textile material is submerged in a bath containing said solution and wherein said first portion is submerged for a longer period of time than said second portion.

40. A process according to claim 37, wherein said solution is sprayed onto said first and second portions of said substrate.

41. A process according to claim 36, wherein said reducing agent is zinc formaldehyde sulfoxylate.

42. A process according to claim 36, wherein said polypyrrole compound is a polypyrrole compound comprising monomers selected from pyrrole, 3- and 3,4-alkyl or aryl substituted pyrrole, N-alkyl pyrrole and N-aryl pyrrole.

43. A process according to claim 41, wherein said polymeric compound is polypyrrole.

44. A process according to claim 36, further comprising rinsing said first and second portion of said substrate with a second solution to substantially terminate chemical reduction of said polymeric material by said reducing agent, wherein said first solution is soluble in said second solution.

45. A process according to claim 43, further comprising rinsing said first and second portion of said substrate with a second solution at a temperature of at least 50° C. to substantially terminate chemical reduction of said polymeric material by said reducing agent, wherein said first solution is soluble in said second solution.

46. A process according to claim 41, wherein said polymeric material is polyaniline compound comprising monomers selected from aniline and 3- and 3,4- chloro, bromo, alkyl or aryl substituted aniline.

47. The process for raising the resistivity of a conductive polymer material, comprising the steps of contacting a first portion of said polymeric material with a solution containing a reducing agent capable of chemically reducing said polymeric material, contacting a second portion of said polymeric material with said solution, maintaining contact between said solution and said first portion of said polymeric material until the resistivity of said first portion is raised to a level, L ohms per square, and maintaining contact between said solution and said second portion of said polymeric material until the resistivity of said second portion is raised to a level, $L_2$ ohms per square, whereby $L_1$ is greater than $L_2$.

48. The process according to claim 47 wherein said polymeric material is selected from a polypyrrole compound, a polyaniline compound, a polyacetylene compound and a polythiophthene compound.

49. The process according to claim 48 wherein said reducing agent is selected from zinc formaldehyde sulfoxylate;
sodium formaldehyde sulfoxylate;
thiourea dioxide;
sodium hydrosulfite;
sodium borohydride;
zinc;
hydrazine;
and stannous chloride.

50. The process according to claim 49 wherein said solution is aqueous and said solution is heated to a temperature of between 25° C. and 100° C. while said solution is in contact with said polymeric material.

51. The product of the process of claim 17.

52. The product according to claim 51 wherein said polymeric material is in the form of a coating on a textile material.

53. The product according to claim 52 wherein said polymeric material is polypyrrole.

54. The product according to claim 53 wherein said reducing agent is selected from zinc formaldehyde sulfoxylate;
sodium formaldehyde sulfoxylate;
thiourea dioxide;
sodium hydrosulfite;
sodium borohydride;
zinc;
hydrazine;
and stannous chloride.

55. A textile material comprising first and second portions coated with a film of a conductive polymer selected from a polypyrrole compound and a polyaniline compound, said film being of equal and uniform thickness on each of said first and second portions, wherein the resistivity of said first portion is greater than a resistivity of said second portion.

56. A textile material according to claim 55 wherein said film of polymer on said second portion has been chemically reduced.

57. A textile material according to claim 56 wherein said polymer is polypyrrole.

58. A textile material according to claim 56 wherein said film of polymer on said second portion has been chemically reduced by a reducing agent selected from zinc formaldehyde sulfoxylate;
sodium formaldehyde sulfoxylate;
thiourea dioxide;
sodium hydrosulfite;
sodium borohydride;
zinc;
hydrazine;
and stannous chloride,

* * * * *